United States Patent [19]

Iwasaki et al.

[11] Patent Number: 4,985,086

[45] Date of Patent: Jan. 15, 1991

[54] METHOD AND APPARATUS FOR PRODUCING MAGNETICALLY ANISOTROPIC ND-FE-B MAGNET MATERIAL

[75] Inventors: Katsunori Iwasaki; Yasuto Nozawa, both of Kumagaya; Shigeho Tanigawa, Konosu, all of Japan

[73] Assignee: Hitachi Metals, Ltd., Tokyo, Japan

[21] Appl. No.: 361,685

[22] Filed: Jun. 2, 1989

Related U.S. Application Data

[63] Continuation of Ser. No. 112,876, Oct. 27, 1987, abandoned.

[30] Foreign Application Priority Data

Sep. 10, 1987 [JP] Japan ..... 62-227387

[51] Int. Cl.[5] ..... H01F 1/02

[52] U.S. Cl. ..... 148/101; 148/104; 419/12; 419/49

[58] Field of Search ..... 148/101, 105, 104; 419/12, 49

[56] References Cited

FOREIGN PATENT DOCUMENTS

| | | |
|---|---|---|
| 0101552 | 2/1984 | European Pat. Off. . |
| 0133758 | 3/1985 | European Pat. Off. . |
| 0174735 | 3/1986 | European Pat. Off. . |
| 59-46008 | 3/1984 | Japan . |
| 60-100402 | 6/1985 | Japan . |
| 61-34242 | 8/1986 | Japan . |

*Primary Examiner*—John P. Sheehan

*Attorney, Agent, or Firm*—Finnegan, Henderson, Farabow, Garrett & Dunner

[57] ABSTRACT

A method of producing a magnetically anisotropic Nd-Fe-B magnet material comprising the steps of: charging a green body produced by pressing a flaky or powdery material consisting of an amorphous alloy and/or a finely crystallized alloy, into a cavity defined by a die having a hole extending therethrough, a lower plunger inserted into said hole, and an upper plunger having a larger diameter than that of said hole; pressing said green body by elevating said lower plunger while keeping a temperature thereof (pressing temperature) at 600°-850°; elevating the resulting pressed body by elevating said lower plunger while heating; and upsetting said pressed body while keeping a temperature thereof (upsetting temperature) at 600°-850° C. to provide it with magnetic anisotropy.

14 Claims, 5 Drawing Sheets

METHOD AND APPARATUS FOR PRODUCING MAGNETICALLY ANISOTROPIC ND-FE-B MAGNET MATERIAL

This application is a continuation of application Ser. No. 07/112,876, filed Oct. 27, 1987, now abandoned.

BACKGROUND OF THE INVENTION

The present invention relates to a method and an apparatus for producing a magnetically anisotropic Nd-Fe-B magnet material having large coercive force and magnetic energy product by compressing a green body and treating it to have magnetic anisotropy, the green body being obtained by cold forming of flakes or powders obtained by pulverizing an Nd-Fe-B magnetic ribbon formed by a rapid quenching method.

It is conventionally known as disclosed in Japanese Patent Publication No. 61-34242 to produce an Nd-Fe-B sintered magnet by preparing an ingot by melting a mixture of Nd, Fe, B and if necessary additional elements, pulverizing it to form powder, sintering and heat-treating it. Further, it is known that an Nd-Fe-B magnet can be provided with a high coercive force by making the crystal grains of the magnet finer, for instance, to an average grain size of about 0.01–0.5 μm. This fine crystal-type Nd-Fe-B magnet is disclosed, for instance, in Japanese Patent Laid-Open No. 60-100402. It is also disclosed that die upsetting can provide the magnet with magnetic anisotropy, but it is not disclosed how a pressed powder body having fine crystal grains can be efficiently formed into a compressed body with magnetic anisotropy, and what deformation by upsetting can increase the magnetic properties of the compressed body.

OBJECT AND SUMMARY oF THE INVENTION

The present invention is aimed at providing a method of efficiently producing a magnetically anisotropic Nd-Fe-B magnet of a substantially fine crystal type. More specifically, it is aimed at providing a magnetically anisotropic Nd-Fe-B magnet material with high coercive force and magnetic energy product by carrying out the compression of a pressed powder body and giving magnetic anisotropy thereto more efficiently than conventional methods. Another object of the present invention is to provide an apparatus for producing a magnetically anisotropic Nd-Fe-B magnet by upsetting in such a manner as to form such a final shape as a field magnet for voice coils (mostly fan shape), a field magnet for generators (mostly arc segment shape), a magnet for speakers (mostly doughnut shape) or a field magnet for flat motors (mostly circular shape).

To achieve the above objects, the present invention provides the following method. That is, A method of producing a magnetically anisotropic Nd-Fe-B magnet material represented by the formula:

$$(Nd_{1-x}A_x)_{11-18}(Fe_{1-y}Co_y)_{bal}B_{4-11}M_z$$

wherein $0 \leqq x \leqq 1$, $y \leqq 0.3$, $z \leqq 3$, M represents one or more elements other than Nd, Dy, Pr, Fe, Tb, Co and B, and A represents one or more elements selected from Dy, Pr and Tb, and having an average crystal grain size of 0.01–0.5 μm, comprising the steps of:

charging a green body produced by pressing a flaky or powdery material consisting of an amorphous alloy and/or a finely crystallized alloy, into a cavity defined by a die having a hole extending therethrough, a lower plunger inserted into the hole, and an upper plunger having a larger diameter than that of the hole:

pressing the green body by elevating the lower plunger while keeping a temperature thereof (pressing temperature) at 600°–850° C.;

elevating the resulting pressed body by elevating the lower plunger while heating: and upsetting the pressed body while keeping a temperature thereof (upsetting temperature) at 600°–850° C. to provide it with magnetic anisotropy.

DETAILED DESCRIPTION OF THE INVENTION

With respect to the composition of the magnet material, Pr and Nd have substantially the same effects, so that part or all of Nd may be replaced by Pr. A substitution of part of Nd with Dy or Tb provides a fine crystal-type magnet with particularly high coercive force and excellent thermal stability. Specifically, x is 0–0.3 when A is Dy or Tb.

When the total of Nd and the A element is less than 11 atomic %, sufficient intrinsic coercive force iHc cannot be obtained, and when it exceeds 18 atomic %, the Br decreases. Therefore, the total of Nd plus A is 11–18 atomic %.

When B is less than 4 atomic %, an $R_2Fe_{14}B$ phase, a main phase of the alloy of the present invention cannot be fully formed, giving low residual magnetic flux density Br and intrinsic coercive force iHc. On the other hand, when B exceeds 11 atomic %, a magnetically undesirable phase appears, resulting in the decrease in Br. Therefore, the amount of B is 4–11 atomic %.

By substituting part of Fe with Co, the Curie temperature of the alloy can be enhanced, reducing the temperature variation of residual magnetic flux density thereof.

When the amount of Co substituted for Fe (y) exceeds 0.3, the Curie temperature is elevated but the anisotropy constant of the main phase decreases, making it difficult to obtain high iHc. Therefore, y is 0.3 or less.

M is one or more elements other than Nd, Dy, Pr, Fe, Tb, Co and B, and it is preferably Ga, Zr, Hf, Nb, Ta, Si, Zn, Al or Ti. When the amount (z) of the additional element M exceeds 3 atomic %, a large decrease in Br takes place. Thus, z is 3 or less. Incidentally, the alloy of the present invention may contain Nb coming from ferroboron.

In the present invention, when an average size of fine crystal grains in the alloy exceeds 0.5 μm, the iHc of the alloy decreases and the irreversible loss of flux thereof at 160° C. becomes 10% or more, extremely lowering thermal stability of magnet materials made from the alloy. On the other hand, when the average size is less than 0.01 μm, the iHc is also low, unable to provide the desired permanent magnet. Therefore, the average size of the fine crystal grains in the alloy is limited to 0.01–0.5 μm.

In the present invention, flaky or powdery starting alloy material may be prepared by the following procedures.

First, an alloy of a predetermined composition is prepared by high-frequency melting or arc melting, etc., and the alloy is rapidly quenched to form flakes. The rapid quenching can be carried out by either of a single roll method or a double roll method, and materials for the roll may be Fe, Cu, etc. When Cu is used for the roll, it is preferably plated with Cr. The rapid quenching is conducted in an inert gas atmosphere such as Ar, He, etc. to prevent the oxidation of the alloy. The resulting flakes are pulverized to 100–200 μm or so. The coarse powder thus formed is pressed at room temperature to provide a green body.

Figure 1:
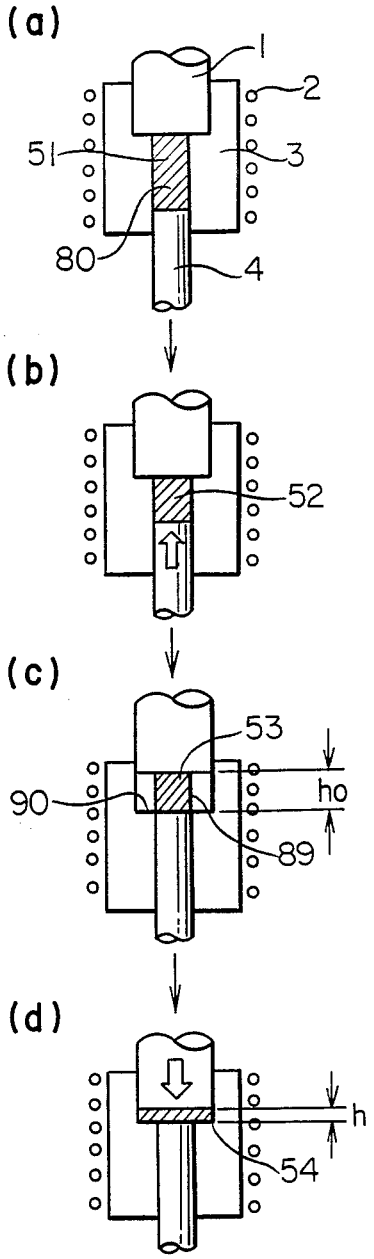
FIGS. 1(*a*) to 1(*d*) are a view showing the steps according to one embodiment of the present invention.
Figure 2:
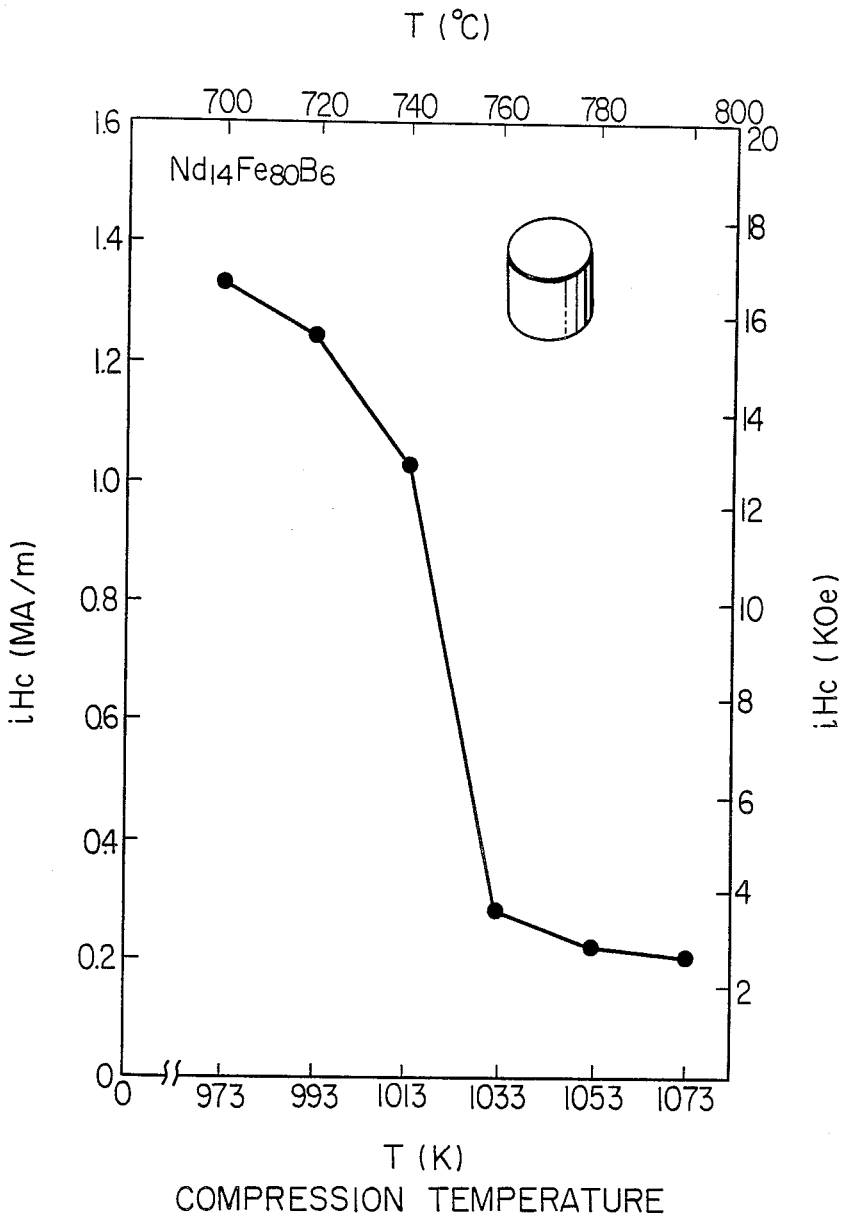
FIG. 2 is a graph showing the influence of the compression temperature on coercive force.

The green body is placed in a cavity of a die 3 for compression as shown in FIG. 1, and it is kept at temperatures between 600° C. and 850° C. by high-frequency heating. It is compressed by elevating a lower plunger 4, and elevated to an upsetting position by elevating the lower plunger 4 while heating with a high-frequency heater 2, and then upset at temperatures of 600°–850° C. by lowering an upper plunger 1 while keeping the lower plunger 4 stationary. If the compression of the green body is insufficient, magnetic anisotropy cannot be fully obtained by die upsetting. Thus, it is important to carry out compression at 600°–850° C. to produce a pressed body having a relatively small crystal grain size. When the compression temperature is lower than 600° C., the green body to be pressed has too much resistance to deformation, making the compression difficult. On the other hand, when it exceeds 850° C., crystal grains grow too such, resulting in an extreme decrease in intrinsic coercive force iHc. FIG. 2 shows how the coercive force varies depending upon the compression temperature in the pressed powder body of $Nd_{14}Fe_{80}B_6$. For alloys to which the present invention is applied, the compression and the die upsetting are preferably conducted at 700°–760° C. As is shown in FIGS. 1 (*c*) and (*d*), the upsetting of the pressed body at 600°–850° C., particularly 700°–760° C., can provide an anisotropic flat plate. In this case, the lowering speed of the upper plunger, which determines how fast strain is imparted to the pressed body greatly affects the magnetic properties of the resulting magnet alloy.

Figure 3:
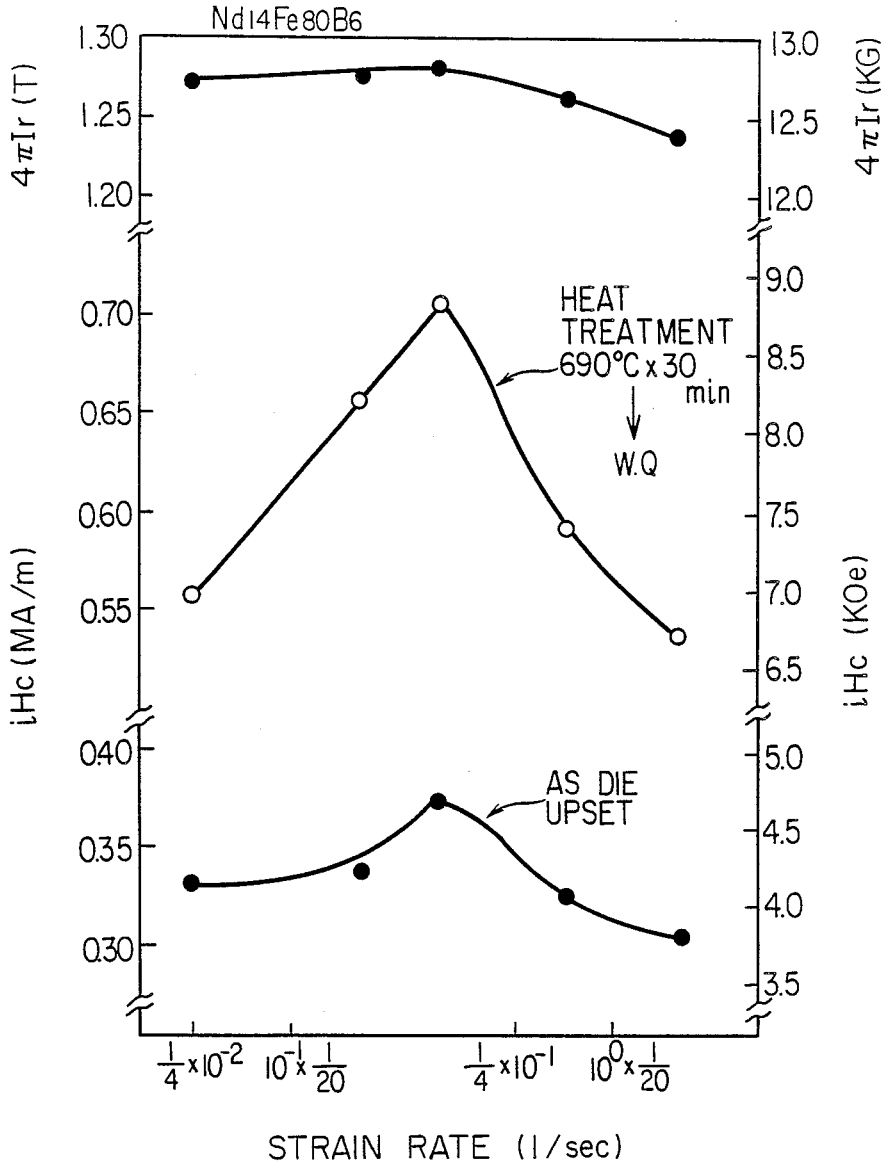
FIG. 3 is a graph showing the relations between a strain rate and magnetic properties.

A strain rate is defined herein as $\Delta h/h_0$, wherein $\Delta h$ is the distance the upper plunger is lowered per second, and $h_0$ is the initial height of the pressed body. The intrinsic coercivity ($iH_c$) and residual magnetic flux density ($4\pi I_r$) depend upon the strain rate as shown in FIG. 3. When the strain rate is too small, the upsetting process becomes too lengthy. Thus, the is preferably about $1\times10^{-5}$/sec. or more. On the other hand, when the strain rate is too high, an extreme decrease in residual magnetic flux density Br($4\pi$Ir) ensues. Thus, the strain rate is preferably about $1\times10^{-1}$/sec or less. More preferably, with the strain rate between about $4\times10^{-3}$/sec. and about $4\times10^{-2}$/ sec., magnetically anisotropic magnet material with a large magnetic energy product can be obtained by the upsetting process step.

If necessary, the resulting flat plate may be subjected to a heat treatment of rapid quenching after heating at 600°–800° C. to increase the iHc thereof.

By selecting a proper shape of the die cavity for effecting the upsetting, a magnetically anisotropic upset magnet in the shape of disc, doughnut or fan can be produced.

The flat plate may be pulverized to form powder for anisotropic resin-bonded magnets.

Also, both the pressing step and the upsetting step can be carried out under reduced pressure of 0.1 Torr or less.

The present invention will be further described in detail by the following Examples.

EXAMPLE 1

Figure 4:
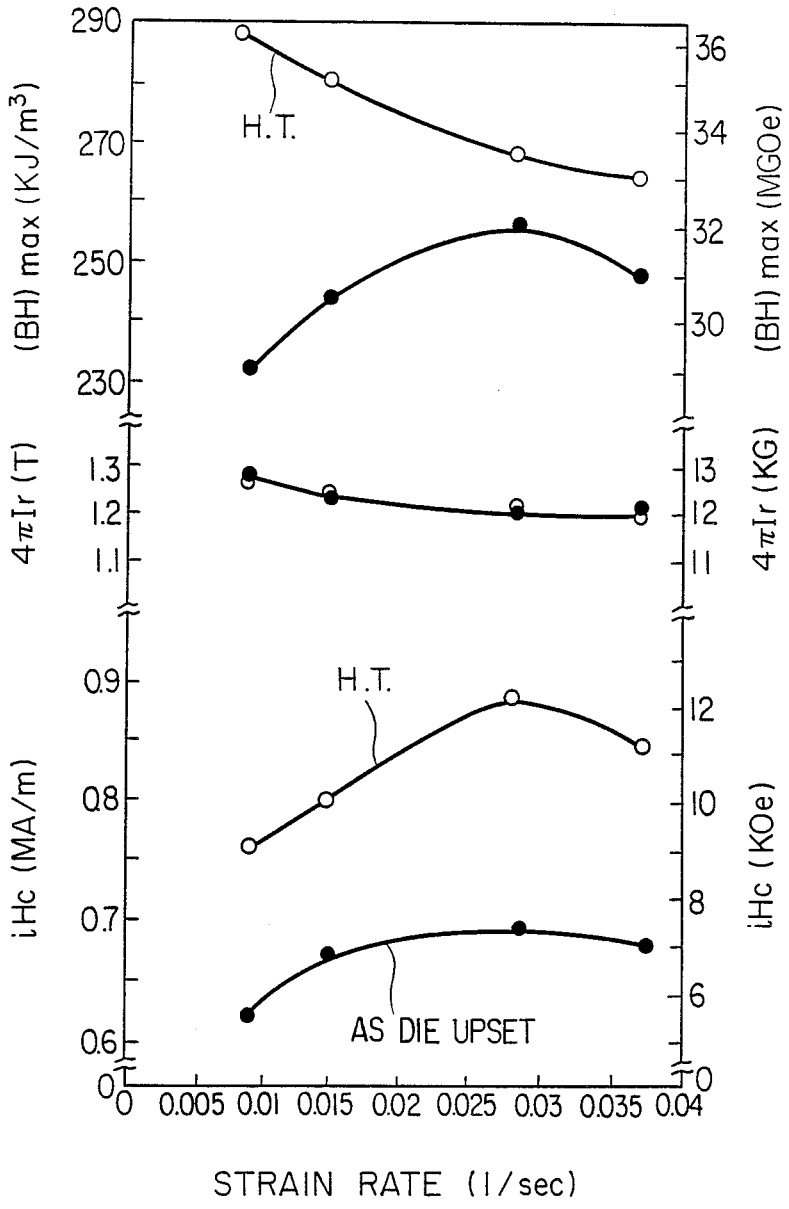
FIG. 4 is a graph showing relations similar to those of FIG. 3 for the magnet of $Nd_{14}Fe_{80}B_6$.

An $Nd_{14}Fe_{80}B_6$ alloy was prepared by arc melting, and formed into flakes by a single roll method in an Ar atmosphere. The flakes obtained at a roll peripheral speed of 30 m/sec. were in an irregular shape having a thickness of about 30 μm. It was found by X-ray diffraction that they were composed of a mixture of an amorphous phase and a finely crystalline phase phase. These flakes were pulverized to 32 mesh or less, and formed into a green body by die pressing. The pressing pressure was 6 tons/cm$^2$, and no magnetic field was applied. The green body had a diameter of about 15 mm and a height of about 30 mm, and the density of the green body was 5.8 g/cc. This green body 51 was placed in a cavity 80 as shown in FIG. 1, and compressed at 700° C. under pressure (about 2 tons/cm$^2$) by the lower plunger 4 to provide a pressed body 52 of about 15 mm in diameter and about 20 mm in height. This pressed body 52 had a density of 7.4 g/cc which was the theoretical density of 7.5 g/cc such as can be obtained by melt-processing. While continuing high-frequency heating, it was raised by elevating the lower plunger 4, and after the upper surface 89 of the lower plunger reached the top surface of the hole 90, the upper plunger 1 was lowered to compress this pressed body 53 at 700° C. to conduct the upsetting thereof to provide a disc-shaped, magnetically anisotropic magnet material 54 having a diameter of about 40 mm. With the lowering speed of the upper plunger being varied, the relations between the strain rate and the magnetic properties were investigated. The results are shown in FIG. 4, in which the term "H.T." denotes the magnetic properties of the alloy cooled with water after die upsetting at 690° C. for 30 minutes.

Figure 5:
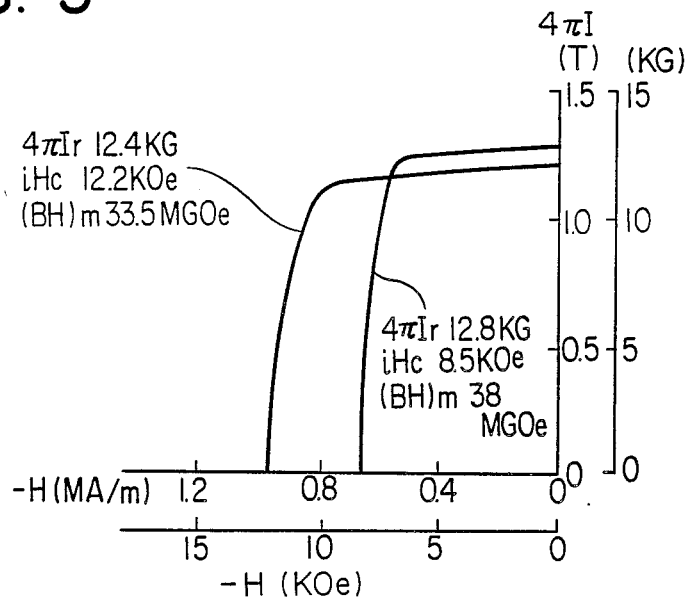
FIG. 5 is a graph showing the demagnetization curves of the upset magnets ($Nd_{14}Fe_{80}B_6$) of the present invention.

As a result of investigating production conditions, two types of magnet materials showing the magnetization curves as shown in FIG. 5 were obtained by proper working conditions. The compression ratio $h_0/h_f$ was set at 3.5 or more where $h_f$ is the final height dimension.

EXAMPLE 2

With the alloy composition of $Nd_{14}Fe_{77}B_8M_1$, Example 1 was repeated to prepare an upset magnet with magnetic properties as shown in Table 1.

TABLE 1

| Additional Element (M) | Effects of Various Additional Elements 4πIs (KG) | 4πIr (KG) | iHc (KOe) | bHc (KOe) | (BH)max (MGOe] |
|---|---|---|---|---|---|
| Ga | 10.5 | 9.9 | 21.1 | 9.3 | 23 |
| Zr | 9.5 | 8.4 | 15.5 | 7.5 | 16 |
| Hf | 9.0 | 7.8 | 15.7 | 6.9 | 14 |
| Nb | 9.9 | 9.1 | 12.6 | 7.9 | 19 |
| Ta | 10.4 | 9.7 | 12.3 | 8.3 | 22 |
| Si | 11.6 | 11.3 | 9.5 | 8.7 | 31 |
| Zn | 11.3 | 10.8 | 15.1 | 10.1 | 29 |
| Al | 11.2 | 10.7 | 15.3 | 9.9 | 27 |
| Ti | 10.0 | 9.5 | 11.3 | 8.6 | 21 |
| $Nd_{14}Fe_{80}B_6$ | 12.3 | 12.0 | 7.3 | 6.6 | 32 |

(Note) Composition: $Nd_{14}F_{77}B_8M_1$
Upsetting temperature: 983K. (710° C.]

Figure 6:
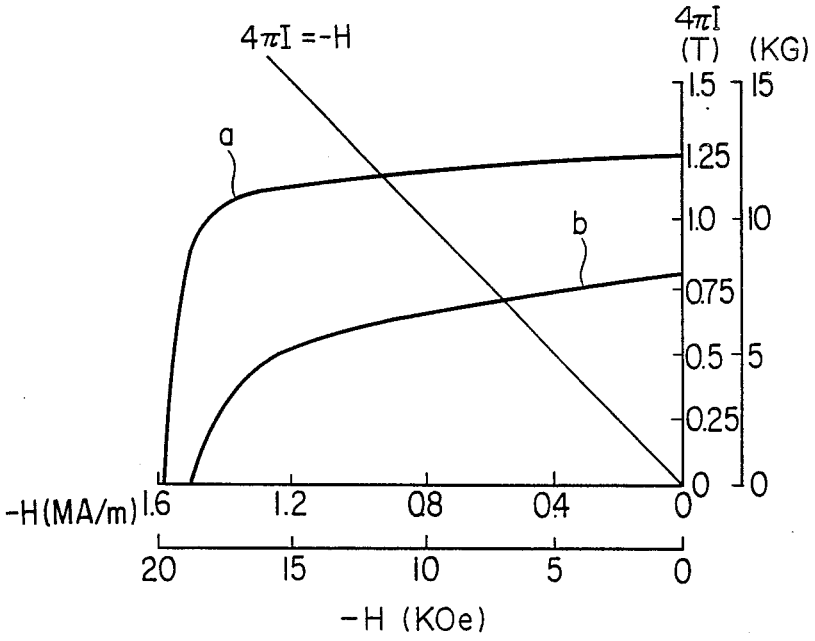
FIG. 6 is a graph showing the demagnetization curves of the magnet "a" ($Nd_{14}Fe_{77}B_8Ga_1$) of the present invention.

The magnet containing Ga was further investigated with respect to composition, working condition, and heat treatment conditions. The $Nd_{14}Fe_{79.25}B_6Ga_{0.75}$ magnet having the magnetization curve "a", which was prepared by hot pressing at 620° C., upsetting at 675° C. and heat treating at 650° C. for 1 hour and then water cooling is shown in FIG. 6. The curve "b" shows the magnet prepared by pulverizing the magnet "a" by a disc mill to 105–250 μm and compressing it.

EXAMPLE 3

Figure 7:
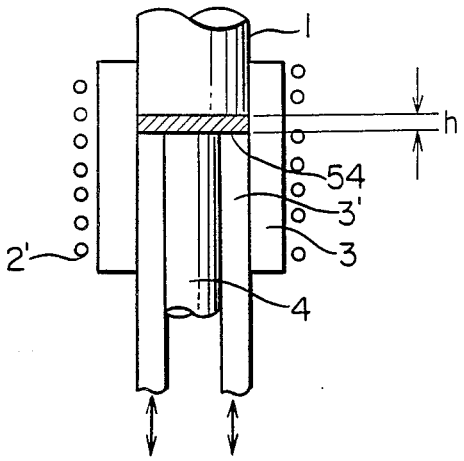
FIG. 7 is a view showing a separate-type die for making it easier to withdraw an upset magnet according to another embodiment of the present invention.
Figure 8:
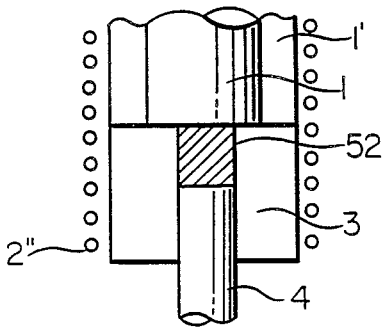
FIG. 8 is a view showing a die apparatus having a separate-type upper plunger according to a further embodiment of the present invention.

As is shown in FIG. 7, with a concentrically dividable die 3', the upset magnet 54 can be easily withdrawn by elevating the lower plunger 4 and an inner die 1 simultaneously. And with a concentrically dividable upper plunger 1' shown in FIG. 8, the formed magnet can be withdrawn laterally after elevating the upper plunger. As a further embodiment, the die may have a plurality of steps on the upper side to carry out multi-step upsetting.

As described above in detail, the present invention can provide a magnetically anisotropic Nd-Fe-B magnet material with high coercive force and high magnetic energy product. And the following effects are attained:

(1) As compared to a method in which upsetting is carried out after replacing a die after compression while heating, operation efficiency is greatly high, saving much time and energy.

(2) In the case of conducting upsetting by exchanging a die after the compression step, the temperature of the pressed body is inevitably lowered, resulting in the decrease in magnetic properties, particularly intrinsic coercive force iHc of the resulting magnet for unknown reasons, but such deterioration of the magnetic properties does not substantially take place in the present invention.

(3) With a separate-type die structure, the upset magnet material with good properties can be produced with higher efficiency.

What is claimed is:

1. A method of producing a magnetically anisotropic Nd-Fe-B magnetic material comprising the steps of:

forming a green body consisting of an amorphous alloy material and/or a finely crystallized alloy material represented by the formula (in at %):

$$(Nd_{1-x}A_x)_{11-18}(Fe_{1-y}Co_y)_{bal}B_{4-11}M_z$$

wherein $0 \leqq x \leqq 1$, $y \leqq 0.3$, $z \leqq 3$, M represents one or more elements other than Nd, Dy, Pr, Fe, Tb, Co and B, and A represents one or more elements selected from Dy, Pr and Tb, and having an average crystal grain size of 0.01–0.5 μm;

pressing said green body using die means while keeping the temperature thereof (pressing temperature) at 600°–850° C., to produce a pressed green body said pressed green body having a thickness measured along the direction of pressing;

maintaining continuously the temperature of said pressed green body at 600°–850° C.; and upsetting the entirety of said temperature maintained pressed green body to reduce the thickness of the material relative to the pressed green body thickness, using die means while keeping the temperature (upsetting temperature) at 600°–850° C. to provide it with magnetic anisotropy, wherein said forming step includes the step of prepressing flakes of powder of the alloy material, wherein the same die means is used for both said pressing and said upsetting steps, and wherein the temperature of said material is maintained between about 600°–850° C. from the beginning of said pressing step to the end of said upsetting step.

2. The method of producing a magnetically anisotropic Nd-Fe-B magnet material according to claim 1, wherein said forming step includes the step of selecting M to represent one or more elements from the group consisting of Ga, Zr, Hf, Nb, Ta, Si, Zn, Al and Ti.

3. The method of producing a magnetically anisotropic Nd-Fe-B magnet material according to claim 1, wherein the pressing temperature and the upsetting temperature are respectively within the range of 700°–760° C.

4. The method of producing a magnetically anisotropic Nd-Fe-B magnet material according to claim 1, wherein in the upsetting step, said magnet material is plastically deformed at a strain rate of about $1 \times 10^{-5}$/sec. to about $1 \times 10^{-1}$/sec.

5. The method of producing a magnetically anisotropic Nd-Fe-B magnet material according to claim 4, wherein said strain rate is about $4 \times 10^{-3}$ to about $4 \times 10^{-2}$/sec.

6. The method of producing a magnetically anisotropic Nd-Fe-B magnet material according to claim 1, wherein both of the pressing step and the upsetting step are carried out under reduced pressure of 0.1 Torr or less.

7. The method of producing a magnetically anisotropic Nd-Fe-B magnet material according to claim 1, wherein the upsetting step is carried out with appropriate die means for providing a fan-shaped, arc segment-shaped or doughnut-shaped magnet material.

8. The method of producing a magnetically anisotropic Nd-Fe-B magnet material according to claim 1, wherein said pressing step includes pressing to form a pressed body having a density which is 95% or more of the theoretical density thereof.

9. The method of producing a magnetically anisotropic Nd-Fe-B magnet material according to claim 1 wherein the die means includes a die having an upsetting cavity formed therein, a hole communicating with the cavity, a first plunger inserted in the hole, and a second plunger having a larger diameter than that of the hole inserted within the cavity, wherein said forming step includes the step of charging the green body into the hole between the first plunger and the cavity;

said pressing step includes the steps of moving the first plunger while blocking the hole with the second plunger;

said maintaining step includes the step of transferring the pressed green body by retracting the second plunger and further moving the first plunger to transfer the pressed green body to the upsetting cavity; and wherein said upsetting step includes the steps of blocking the hole with the first plunger while deforming the pressed green body with the second plunger.

10. A method of producing a magnetically anisotropic Nd-Fe-B magnetic material comprising the steps of:

forming a green body consisting of an amorphous alloy material and/or a finely crystallized alloy material represented by the formula (in at %):

$$(Nd_{1-x}A_x)_{11-18}(Fe_{1-y}Co_y)_{bal}B_{4-11}M_z$$

wherein $0 \leqq x \leqq 1$, $y \leqq 0.3$, $z \leqq 3$, M represents one or more elements other than Nd, Dy, Pr Fe, Tb, Co and B, and A represents one or more elements selected from Dy, Pr and Tb, and having an average crystal grain size of 0.01–0.5 μm;

pressing said green body using die means while keeping the temperature thereof (pressing temperature) at 600°–850° C., to produce a pressed green body said pressed green body having a thickness measured along the direction of pressing; and upsetting said pressed green body to reduce the thickness of the material relative to the pressed green body thickness using die means at a pre-selected deformation strain rate between about $1 \times 10^{-5}$/sec. to about $1 \times 10^{-1}$/sec. while keeping the temperature thereof (upsetting temperature) at 600°–850° C., wherein said forming step includes the step of prepressing flakes or powder of the alloy material, wherein the same die means is used for both said pressing and said upsetting steps, and wherein the temperatures of the material is maintained between about 600°–850° C. from the beginning of the pressing step to the end of said upsetting step.

11. The method of producing a magnetically anisotropic Nd-Fe-B magnet material according to claim 10 wherein said strain rate is about $4 \times 10^{-3}$/ sec. to about $4 \times 10^{-2}$/sec.

12. The method of producing a magnetically anisotropic Nd-Fe-B magnet material according to claim 10 wherein both said pressing and said upsetting steps are carried out under reduced pressure of 0.1 Torr or less.

13. A method of producing a magnetically anisotropic Nd-Fe-B magnet material comprising the steps of:

forming a green body consisting of an amorphous alloy material and/or a finely crystallized alloy material represented by the formula (in at %):

$$(Nd_{1-x}A_x)_{11-18}(Fe_{1-y}Co_y)_{bal}B_{4-11}M_z$$

wherein $0 \leqq x \leqq 1$, $y \leqq 0.3$, $z \leqq 3$, M represents one or more elements other than Nd, Dy, Pr, Fe, Tb, Co and B, and A represents one or more elements selected from Dy, Pr and Tb, and having an average crystal grain size of 0.01–0.5 μm;

pressing said green body using die means while keeping the temperature thereof (pressing temperature) at 600°–850° C., to produce a pressed green body said pressed green body having a thickness measured along the directions of pressing; and upsetting said pressed green body to reduce the thickness of the material relative to the pressed green body thickness using die means while keeping the temperature thereof (upsetting temperature) at 600°–850° C. to provide it with magnetic anisotropy, wherein both said pressing step and said upsetting step are carried out under reduced pressure of 0.1 Torr or less, wherein said forming step includes the step of prepressing flakes or powder of the alloy material, wherein the same die means is used for both said pressing and said upsetting steps, and wherein the temperature of the material is maintained between about 600°–850° C. from the beginning of the pressing step to the end of said upsetting step.

14. The method of producing a magnetically anisotropic Nd-Fe-B magnet material according to claim 1 wherein the upsetting step includes the step of reducing the material thickness to an essentially constant value across the width of the material defined as perpendicular to the upsetting direction.

* * * * *